US005896162A

United States Patent [19]

Taniguchi

[11] Patent Number: 5,896,162

[45] Date of Patent: Apr. 20, 1999

[54] LED PRINTING HEAD

[75] Inventor: Hideo Taniguchi, Kyoto, Japan

[73] Assignee: Rohm Co., Ltd., Japan,

[21] Appl. No.: 08/809,670

[22] PCT Filed: Oct. 5, 1995

[86] PCT No.: PCT/JP95/02037

§ 371 Date: Mar. 26, 1997

§ 102(e) Date: Mar. 26, 1997

[87] PCT Pub. No.: WO96/11110

PCT Pub. Date: Apr. 18, 1996

[30] Foreign Application Priority Data

| | | | |
|---|---|---|---|
| Oct. 5, 1994 | [JP] | Japan | 6-240986 |
| Oct. 26, 1994 | [JP] | Japan | 6-262514 |
| Nov. 14, 1994 | [JP] | Japan | 6-278929 |
| Jan. 25, 1995 | [JP] | Japan | 7-9999 |

[51] Int. Cl.[6] ..... B41J 2/45

[52] U.S. Cl. ..... 347/244; 347/241; 347/134

[58] Field of Search ..... 347/238, 239, 347/244, 241, 134

[56] References Cited

U.S. PATENT DOCUMENTS

| | | | |
|---|---|---|---|
| 4,318,597 | 3/1982 | Kotani et al. | 347/130 |
| 4,651,176 | 3/1987 | Yamakawa | 347/130 |
| 4,689,694 | 8/1987 | Yoshida | 347/13 |
| 4,807,047 | 2/1989 | Sato et al. | 347/112 |
| 5,166,999 | 11/1992 | Rees et al. | 358/120 |

FOREIGN PATENT DOCUMENTS

| | | |
|---|---|---|
| 56-30155 | 3/1981 | Japan . |
| 57-174281 | 10/1982 | Japan . |
| 59-88704 | 5/1984 | Japan . |
| 62-135145 | 2/1986 | Japan . |
| 61-169814 | 7/1986 | Japan . |
| 62-040426 | 2/1987 | Japan . |
| 62-222862 | 9/1987 | Japan . |
| 62-278064 | 12/1987 | Japan . |
| 63-280220 | 11/1988 | Japan . |
| 64-108071 | 4/1989 | Japan . |
| 3-118170 | 5/1991 | Japan . |
| 4-153049 | 5/1992 | Japan . |
| 4-69148 | 6/1992 | Japan . |
| 61 185760 | 8/1996 | Japan . |

OTHER PUBLICATIONS

International Search Report, PCT/JP95/02037, Jan. 16, 1996.

*Primary Examiner*—N. Le
*Assistant Examiner*—Lamson D. Nguyen
*Attorney, Agent, or Firm*—Fish & Richardson PC

[57] ABSTRACT

In order to improve the resolution of a LED printing head by a comparatively simple method, optical shutters (28) are provided between two rows of rod lens arrays (26) and LED arrays (18) correspondingly to the rod lens arrays (26). The central optical axes of rod lenses (24) in the rod lens arrays (26) are inclined by an angle of inclination 0 in the opposite directions with respect to the direction of perpendicular lines passing the centers of the light-emitting surfaces of LED's (14), and signal light sent out from the LED's (14) is condensed on a photosensitive surface (20) alternately via predetermined rod lens arrays (26) so that one line is formed on the photosensitive surface (20).

8 Claims, 17 Drawing Sheets

LED PRINTING HEAD

FIELD THE INVENTION

This invention relates to LED print heads which utilize light signals emitted from LED's to form latent images for graphic image formation.

BACKGROUND OF THE INVENTION

LED printers and laser printers using light emitting diode (LED) heads, semi-conductor laser heads, etc., to generate light signals which are irradiated onto the surface of light-sensitive materials to form static latent images from which printed graphic images are formed on printing materials are already well known. LED printers, particularly, have recently been the object of widespread attention because they offer advantages such as the possibility of smaller device designs and lower manufacturing costs than laser printers.

Such LED printers, as shown in FIG. 21, consist of: a charging device 102 which electrifies the surface of a revolving light-sensitive drum 100; an LED print head 104 which irradiates light to form static latent images in accordance with the input signals, i.e., the electric signals on the charged light-sensitive sensitive drum 100; a processing device 106 to process the static latent Images; a transcriber 110 to transfer toner, the image formation medium, onto the printing material 108, which is moved in accordance with the revolution of the light sensitive drum 100; a fixing device (not shown in drawing) to fix the toner that is transferred onto the printing material 108 by heating, etc.; and a cleaner 112 to clean the surface of the light-sensitive drum 100.

An LED print head 104 used in such LED printers consists of a substrate 114 on which is formed an electrical circuit, an LED array 116 consisting of LED's which are formed on the substrate and which generate light in accordance with the applied electric signals, and a rod-lens array 118 consisting of cylindrical lenses which condense light generated from the LED array 116 onto the light-sensitive drum 100. These components are assembled in such a way that light generated from the LED array 116 is condensed onto the surface of the electrified light-sensitive drum 100 by means of the rod-lens array 118, such that latent images for graphic images to be formed on the printing material 108 are formed on the light-sensitive drum 100.

The LED array 116 on the LED print head 104, as shown in FIG. 22, consists of LED array chips 16*a*, 16*b*, etc., set apart by a certain distance 1, each chip having a certain number of LED's arranged at a certain pitch P. The LED array chips 16*a*, 16*b*, etc., consist of a chip substrate 122 and a number of light-emitting elements, LED's 124, which are formed on the surface of the chip substrate 122. An electrode 126 made of a conducting metal is connected to the surface of each LED 124. At the other end of the electrode 126 is formed a pad electrode 128, which is electrically connected via a wire (not shown in drawing) to a driver IC (not shown in drawing) mounted on the substrate 114.

Along with recent developments in office automation products, the demand for LED print heads with improved performance, particularly with regard to resolution, has also increased. Resolution is determined by the density of pixels (dpi) forming the image printed on the printing material, and is thus a function of the density of the LED's used as light-emitting elements. However, attaining resolutions above a certain level, such as 480 dpi, using LED print heads is extremely difficult in practice due to limitations in manufacturing precision, as is explained below.

In other words, in order to obtain a resolution or pixel density of 600 dpi, for instance, a pitch P of approximately 42 μum for the LED's 124 on LED array chips 16*a*, 16*b*, etc. , is necessary, 20 μm being the columnwise width W of an LED 124 of conventional size. Assuming that the distance d from the columnwise edge of the chip to that of the neighboring LED 124 is 8 μm, practically the limit of manufacturing precision, the clearance $\ell$ between LED array chips 16*a*, 16*b*, etc. would be approximately 6μm.

Furthermore, the cutting of the stick-shaped chip substrate on which LED 124 is formed into individual LED array chips would generally call for a cutting precision in the order of ±5 μm. Moreover, a margin of error of at least ±10 μm when die bonding the cut individual LED array chips 16*a*, 16*b*, etc., onto the circuit substrate must also be considered. In view of the above limitations in manufacturing precision, it can be seen that realizing a resolution of 600 dpi would be extremely difficult if not altogether impossible.

Thus, in attempting to manufacture LED print heads 104 with above a certain level of resolution, since dimensional errors in cutting a chip substrate stick into LED array chips 16*a*, 16*b*, etc. and errors in die bonding onto circuit substrates inevitably occur during the manufacturing process, and particularly since it is extremely difficult to set the LED's 124 on the end of neighboring LED array chips 16*a*, 16*b*, etc. such that the distance or pitch between them is identical to that between the other LED's 124, that is, since it is extremely difficult to manufacture LED array chips 16*a*, 16*b*, etc. such that all the LED's 124 are formed at a fixed pitch at high density, it has not been possible to satisfy the demand for affordable high resolution LED print heads.

Therefore, the object of the invention is to provide an LED print head with improved resolution using relatively simple methods.

SUMMARY OF THE INVENTION

In view of the aforementioned object, the first aspect of the invention is characterized in that the LED print head comprises: LED arrays consisting of LED's is arranged in one direction such that selective generation of light signals is possible; a light-sensitive object positioned along an axis parallel to the aforementioned LED's arrays such that it can be rotated; lens arrays arranged such that light signals generated from the aforementioned LED's are condensed onto the aforementioned light-sensitve material; and optical shutters positioned with respect to the aforementioned lens arrays such that they can be switched to channel light signals from a-designated aforementioned LED array to a designated aforementioned lens array.

In accordance with a second aspect of the invention, there is an LED print head of the first aspect, wherein the lens arrays comprises of a first and a second lens array, the first lens array consisting of lenses with central optical axes tilted at a slight angle toward one side of the main scanning direction, and the second lens array consisting of lenses with central optical axes tilted at a slight angle toward the side opposite that of the tilt of the lens of the first lens array.

In accordance with a third aspect of the invention, there is an LED print head of the first aspect, wherein the lens arrays comprises a first and a second lens array, the first lens array consisting of lenses with central optical axes tilted at a slight angle toward one side of the main scanning direction, and the second lens array consisting of lenses with central optical axes which do not tilt to either side of the main scanning direction.

In accordance with a fourth aspect of the invention, there is an LED print head of the second or third aspect, wherein the first and second lens arrays are arranged at a slight angle to form a V or inverted configuration as viewed from the main scanning direction.

In accordance with a fifth aspect of the invention, there is an LED print head of the first aspect, wherein the lens arrays comprises a first and a second lens array, with the first and second lens arrays positioned to cross at a slight angle in such a way that their lengthwise sides form a certain angle relative to each other.

In accordance with a sixth aspect of the invention, there is an LED print head of the first aspect, wherein the LED arrays comprises a first and a second LED array, the aforementioned first and second LED arrays comprising LED's set at a certain pitch respectively and at a half-pitch relative to each other in the main scanning direction.

In accordance with a seventh aspect of the invention, there is an LED print head of the first aspect, wherein the optical shutter is a liquid crystal shutter utilizing a ferroelectric liquid crystal.

In accordance with an eighth aspect of the invention, there is an LED print head of the first aspect, wherein the optical shutter is an optical shutter utilizing electro-optic ceramics.

In accordance with a ninth aspect of the invention, there is an LED print head comprising, LED arrays with at least a first and a second array of LED's; a driver IC electrically connected to the first and second arrays of LED's; lens arrays consisting of lenses arranged to condense onto the light-sensitive surface light signals generated from LED's is responding to electric signals from the driver IC; and a switching device set between the common electrical wiring of the first LED array and that of the second LED array.

In accordance with a tenth aspect of the invention, there is an LED print head of the ninth aspect, wherein the LED's of the first LED array and the second LED array are set at a certain pitch respectively and at a half-pitch relative to each other in the main scanning direction.

DESCRIPTION OF PREFERRED EMBODIMENTS

LED print heads according to the invention will be explained with reference to the drawings.

Embodiment 1

Figure 1:
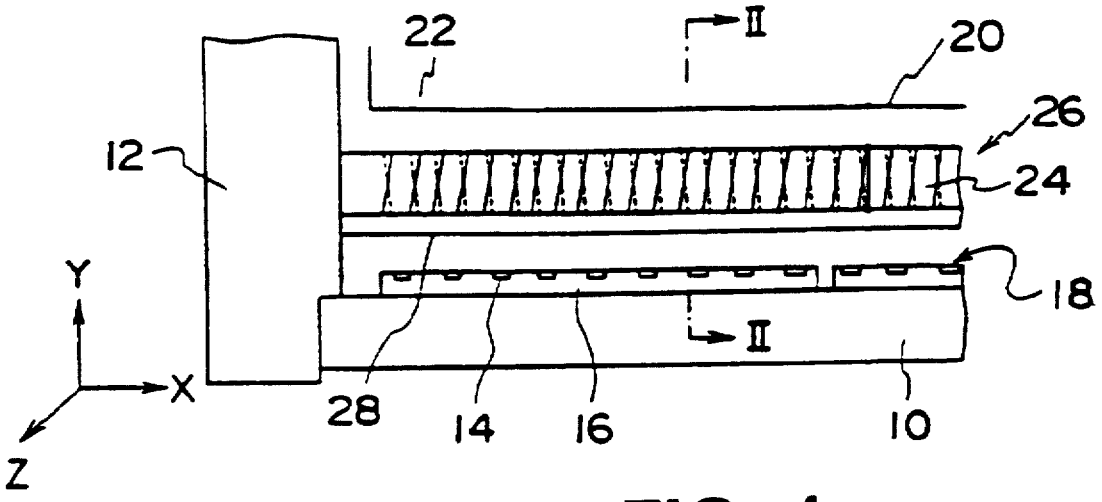
FIG. 1 is a cross-sectional view of an LED print head in accordance with the first embodiment of the invention FIG. 2 (*a*),(*b*), and (*c*) are cross-sectional views along line II—II of FIG. 1.
Figure 2A:
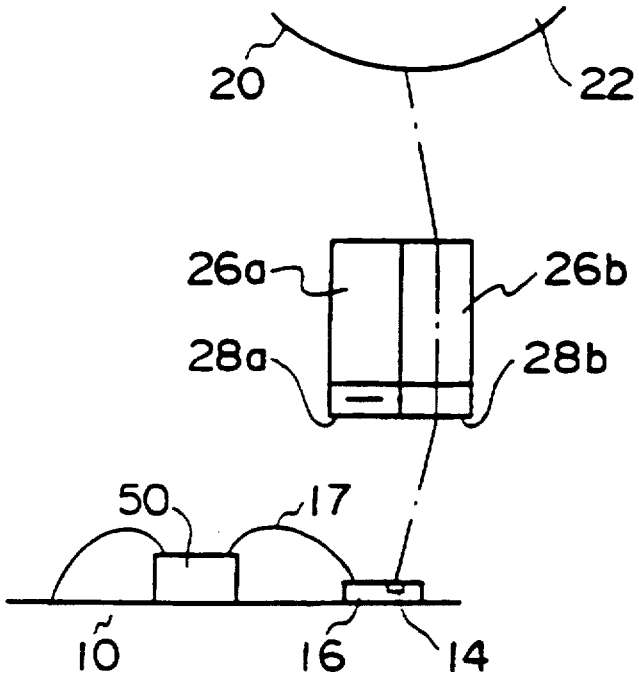
Figure 2B:
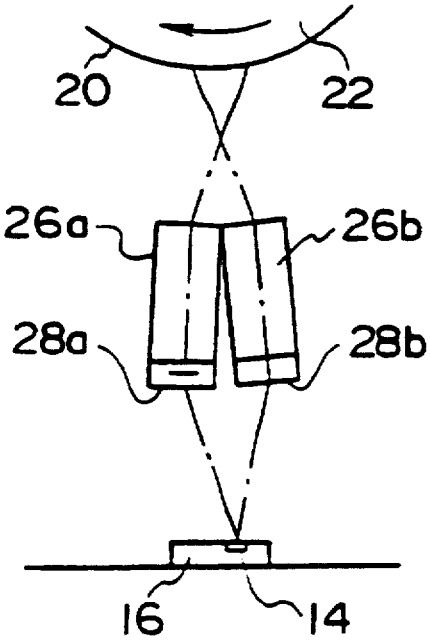
Figure 2C:
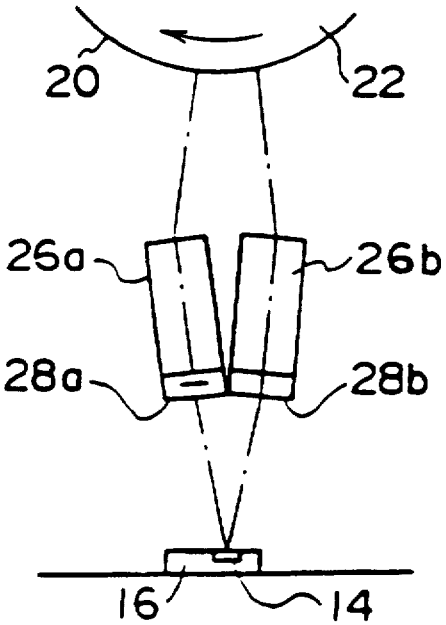

Shown in FIG. 1 are the main elements of an LED print head according to the first embodiment of the invention. A cross-sectional view along line II—II of FIG. 1 is shown in FIG. 2.

In FIG. 1, the substrate 10 is made of glass epoxy material, and is fixed to a housing 12 which holds the main elements of the LED print head. Circuits consisting of semiconductors are formed on the surface of the substrate 10 as required. On the substrate 10, LED array chips 16 comprising a plurality of LED's 14 arranged at a certain pitch are set in a row at a certain distance from each other, and the LED's 14 positioned continuously at a fixed pitch in the main scanning direction (the X-axis in FIG. 1) form LED array 18. The LED array chips 16 are electrically connected via bonding wires 17 to driver IC's 50 (FIG. 2), which are positioned parallel to the array chips.

Above the LED array 18 is a cylindrical light-sensitive drum drum 22, attached to a housing 12 such that it rotates along the X-axis, and formed from a light-sensitive surface 20 onto which light signals generated from the BED's 14 are irradiated.

Between the light-sensitive surface 20 of the light sensitive drum 22 and the LED arrays 18 is the rod-lens array 26 which consists of cylindrical rod lenses 24 with focal lengths that allow for light from each LED 14 to form an image on the light-sensitive surface 20, and which is separated from the LED array 18 by a certain distance. Each rod-lens array 26 consists of two lens arrays: a first lens array 26*a*, wherein each rod lens 24 is slightly tilted toward one side of the X-axis direction at an angle θ with respect to the perpendicular line that passes through the center of the light emission surface of each LED 14, that is, the Y-axis which is perpendicular to both the main scanning direction (x-axis) and the secondary scanning direction (Z-axis); and a second lens array 26*b* which is slightly tilted at an angle θ with respect to the Y-axis in the direction opposite to that of the aforementioned direction.

Although the first lens array 26a and the second lens array 26b of the preferred embodiment are arranged such that each is tilted at an angle θ toward the X-axis direction, the invention is not restricted to this configuration, and a configuration in which each lens of the second lens array 26b is not tilted is also possible.

Figure 3:
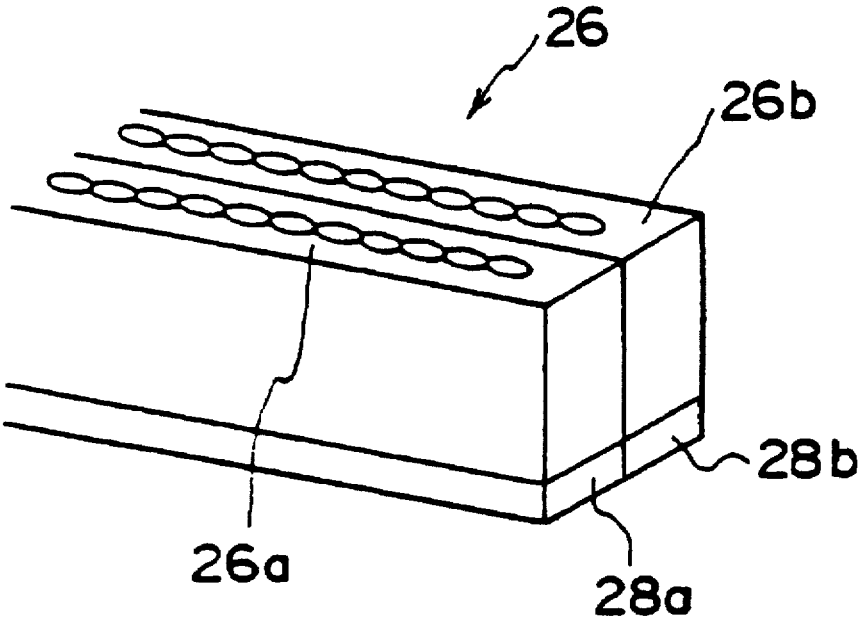
FIG. 3 is a perspective view of the essential parts of the lens array and the optical shutter of FIG. 1.

Installed underneath the lens arrays 26, as is shown in FIG. 2 and FIG. 3, are the optical shutters 28, comprising two rows, the first and the second optical shutters 28a, 28b, corresponding to the first lens array 26a and the second lens array 26b.

Figure 4:
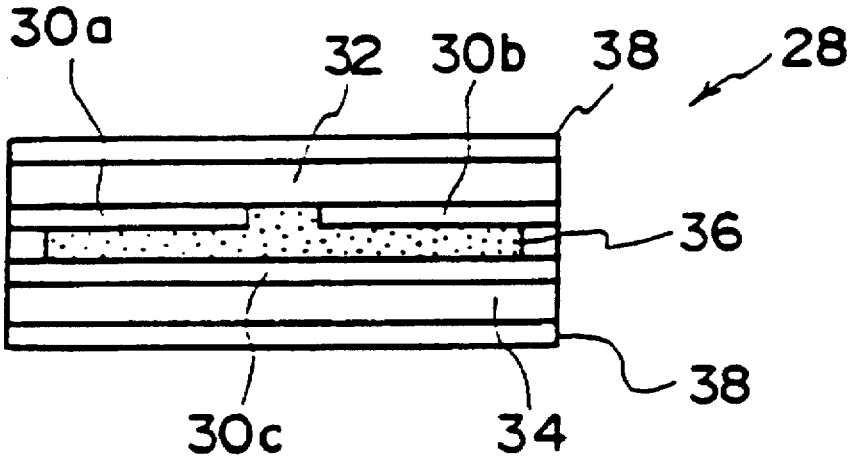
FIG. 4 is a cross-sectional view of an optical shutter utilizing a ferroelectric crystal.

As shown in detail in FIG. 4, the optical shutter 28 is a liquid crystal shutter comprising a ferroelectric crystal 36 sandwiched in between an upper substrate 32, on which transparent electrodes 30a and 30b are formed opposite each other and which is made of glass, and a lower substrate 34 on which a transparent electrode 30c opposite to the transparent electrodes 30a, 30b, is formed. Polarizing plates 38 are adhered to the outer surfaces of both upper and lower substrates 32 and 34.

The optical shutter 28 is a combination of two parts: the shutter area on the left side of FIG. 4, consisting of transparent electrodes 30a and 30c which form the first optical shutter 28a, and the shutter area on the right side of FIG. 4, consisting of transparent electrodes 30b and 30c which form the second optical shutter 28b. In order to enable selective switching, transparent electrodes 30a and 30b are electrically connected to a signal source via a switching circuit not shown in the drawing, and transparent electrode 30c is electrically connected to a signal source via electrical wiring. The opening and shutting of the first and second optical shutters 28a and 28b are performed synchronously with the selective irradiation of the LED's 14 through the driver IC's 50.

Next, image formation along the main scanning direction (X-axis) using the LED print head according to the embodiment will be explained with reference to FIG. 5.

Figure 5A:
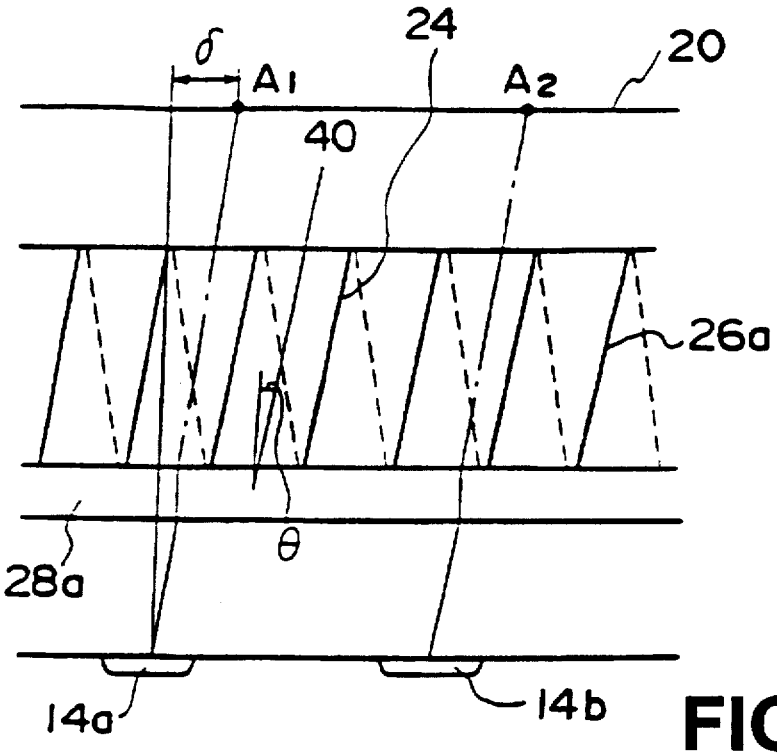
FIG. 5 (*a*) and (*b*) illustrates the operation of the LED print head of the first embodiment of the invention.
Figure 5B:
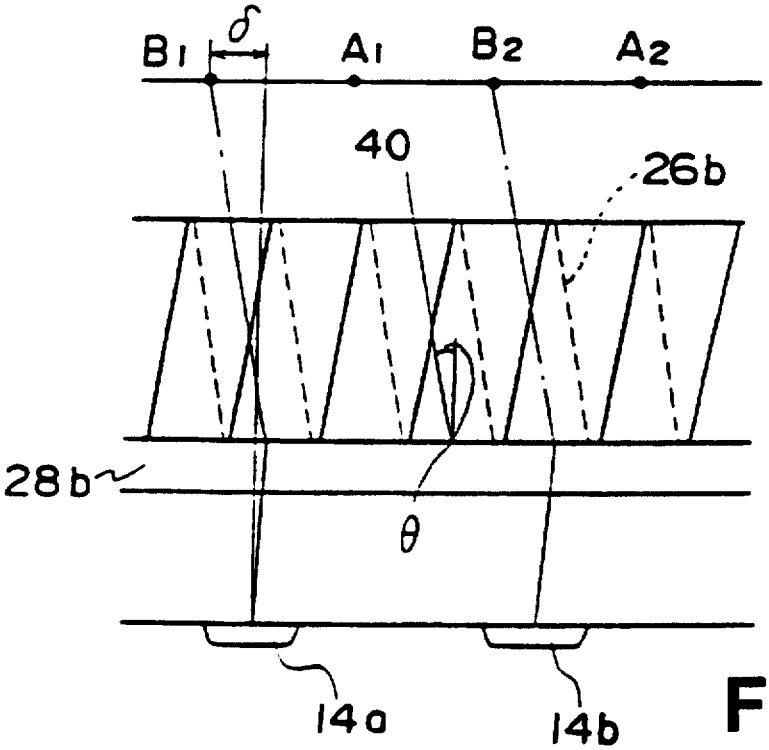

The rod lenses 24 of the first lens array 26a are positioned such that the central optical axes 40 are tilted to one side at an angle θ, as shown in FIG. 5 (*a*). Therefore, when a light signal is generated from an arbitrary LED 14a, and the corresponding first optical shutter 28a is opened and the adjacent optical shutter 28b shut, the light signal forms, via the first lens array 26a, an image on light-sensitive surface 20 at position $A_1$ displaced in the direction of the tilt of the central optical axis by distance δ.

Likewise, when a light signal is also generated from LED 14b adjacent to LED 14a, image formation results at position $A_2$ moved just one LED pitch unit away from image formation position $A_1$. Thus, when the lenses are tilted to one side relative to the Y-axis, light signals from LED's 14 form, via the first lens array 26a, a latent image on light-sensitive surface 20 at positions displaced to one side by distance δ, at a pitch identical to the pitch of the LED's 14.

Next, as shown in FIG. 5 (*b*), the central optical axes 40 of the rod lenses 24 of the second lens array 26b are tilted at an angle θ to the side opposite the aforementioned side. Therefore, when a light signal is generated from the aforementioned LED 14a, the corresponding second optical shutter 28b is opened and the first optical shutter 28a shut, the light signal forming, via the second lens array 26b, an image on the light-sensitive surface 20 at position $B_1$ displaced in the direction of the tilt of the central optical axis by distance δ.

Likewise, when a light signal is also generated from the adjacent LED 14b, image formation results at position $B_2$ moved just one LED pitch unit away from image formation position $B_1$. Thus, when the lenses are tilted to the other side relative to the Y-axis, light signals from the Led's 14 form via the second lens array 26b, latent images on the light-sensitive surface 20 at positions displaced to the other side by distance δ, at a pitch identical to the pitch of the LED's 14.

It should be noted that when the first and the second lens arrays 26a and 26b are positioned parallel to each other as seen from the direction of the x-axis (see FIG. 2 (*a*)), light from a single LED 14 will form images at an identical position via lens arrays 26a and 26b. Therefore, when the light-sensitive drum is rotating at a fixed speed, the latent image formed on light-sensitive surface 20 via the second lens array 26b will not fall on the same line as the latent image formed via the first lens array 26a, but will form a zigzag line. To address this problem, the first and the second lens arrays 26a and 26b as seen from the direction of the X-axis are arranged at a slight angle such that they form an inverted V- or a v-shape, as shown in FIG. 2 (*b*) and FIG. 2 (*c*). In the instance of FIG. 2 (*b*), the latent image formed via the second lens array 26b is formed after the latent image formed via the first lens array 26a has been displaced a certain distance in accordance with the rotation of the light-sensitive drum 22, and it is possible to arrange the latent images on the same line. In the instance of FIG. 2 (*c*), given that the rotational direction of light-sensitive drum 22 is identical to that of FIG. 2 (*b*), if the latent image via the first lens array 26a is formed after the latent image via the second lens array 26b is formed, it is possible to arrange the latent images on the same line, just as in the case of FIG. 2 (*b*). Note that since the order of image formation via the first and second lens arrays 26a and 26b and the rotational direction of the light-sensitive drum 22 can be varied, possible combinations are not restricted to the aforementioned cases.

By giving each rod lens 24 of the lens arrays 26 a tilt angle θ to one side or the other, LED array 18 with LED's 14 set at a certain pitch can be used to obtain graphic images with double pixel density or resolution.

More specifically, if, as in the aforementioned case, the distance between A1 and B1 and that between A1 and B2 are set such that both are 2δ, and the LED's 14 are set at pitch P, then 2δ×2=P holds, yielding δ=P/4. In such a case, there will be one pixel at every 2δ, and therefore pixel density will be double that of the pitch of the LED's 14.

Here, assuming the LED's 14 of LED array 18 are formed at a density of 300 dpi, then the pitch P of the LED's 14 will be 84.6,μm, and substituting in the equation above yields 21.15,μm for δ.

Meanwhile, if D(μm) is the distance between the LED array 18 and the light-sensitive surface 20, the relationship between D and the tilt angle of the central optical axis 40 of the rod-lens array 26 is tan θ=δ/D. Assuming D is 15.1 mm (=15100μm), substituting both δ and θ in the above equation yields a tilt angle θ of 0.0890°.

Therefore, given the above parameters, by setting the tilt angle θ at 0.089°, it can be seen that a graphical image with a resolution of 600 dpi can be obtained with an LED pitch of 300 dpi.

Figure 6:
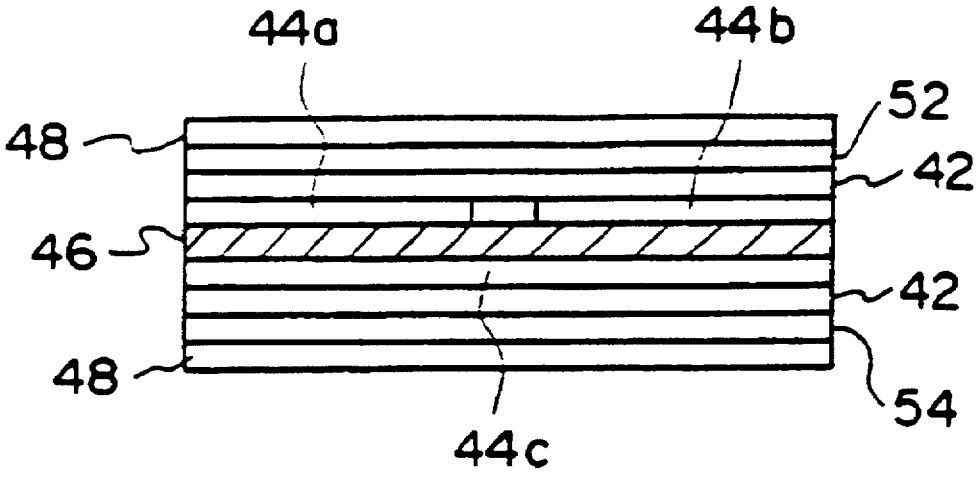
FIG. 6 is a cross-sectional view of an optical shutter using a PLZT.
Figure 7A:
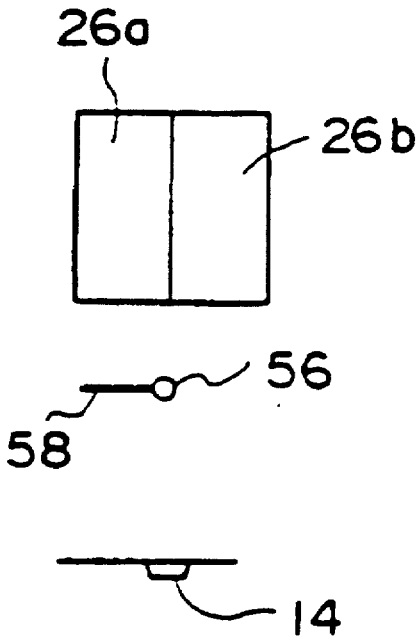
FIG. 7 (*a*) and (*b*) show the structures of mechanical shutters that can be used in the invention.
Figure 7B:
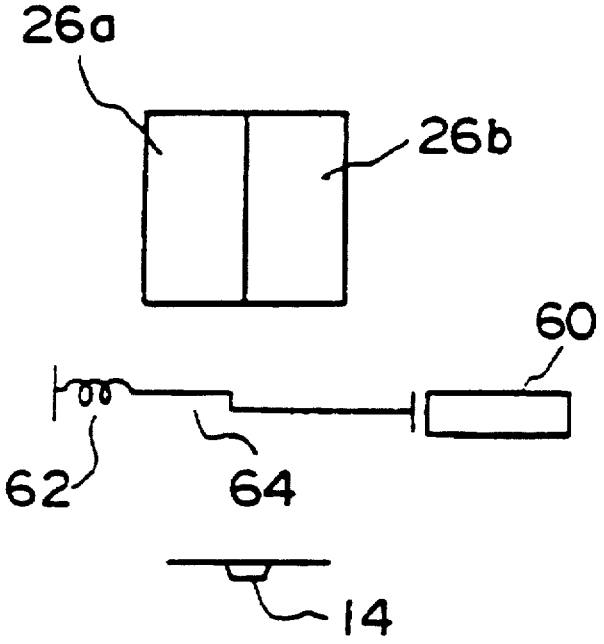

In the aforementioned embodiment, although liquid crystal shutters using ferroelectric liquid crystals were used as optical shutters 28, it is also possible to use instead optical shutters using an electro-optic ceramic material known as PLZT shown in FIG. 6 or the mechanical optical shutter shown in FIG. 7.

The optical shutter made of PLZT shown in FIG. 6 comprises PLZT 46 sandwiches between an upper plate of glass substrate 52 on which transparent electrodes 44*a* and 44*b* are formed opposite each other with silicon rubber in between and a lower plate of glass substrate 54 on which a transparent electrode 44*c* is formed with silicon rubber 42 in between. Polarizing plates 48 are adhered to the outer surfaces of the upper and lower substrates 52 and 54. As in the aforementioned ferroelectric liquid crystal shutter, this optical shutter is also a combination of two parts, namely: the shutter area on the left side of FIG. 6, consisting of transparent electrodes 44*a* and 44*c* which form the first optical shutter 28*a*, and the shutter area on the right side of FIG. 6, consisting of transparent electrodes 44*b* and 44*c* which form the second optical shutter 28*b*. The opening and shutting of the first and second optical shutters 28*a* and 28*b* are performed by synchronization with the selective irradiation of the LED's 14 through driver IC's.

FIG. 7 (*a*) shows the structure of a mechanical optical shutter that can be used in the invention. This optical shutter consists of a light-shielding plate 58 positioned below the first and second lens arrays 26*a* and 26*b* which rotates 180°, for instance, around a shaft 56 in response to an electric signal from a driver IC 50. FIG. 7 (*b*) shows an optical shutter consisting of a light-shielding plate 64 positioned below the first and second lens arrays 26*a* and 26*b* which is held in position by a spring 62 which can be moved along the Z-axis using a solenoid 60 which is controlled via electrical signals from a driver IC. Such mechanical optical shutters can be used as optical shutters 28 by synchronizing emissions from the LED's 14 of the LED array 18 so that light signals are irradiated via the first lens array 26*a* or the second lens arrays 26*b* onto the light-sensitive surface as a result of the shutters.

Embodiment 2

Next, Preferred Embodiment 2 of the invention will be explained.

Figure 8A:
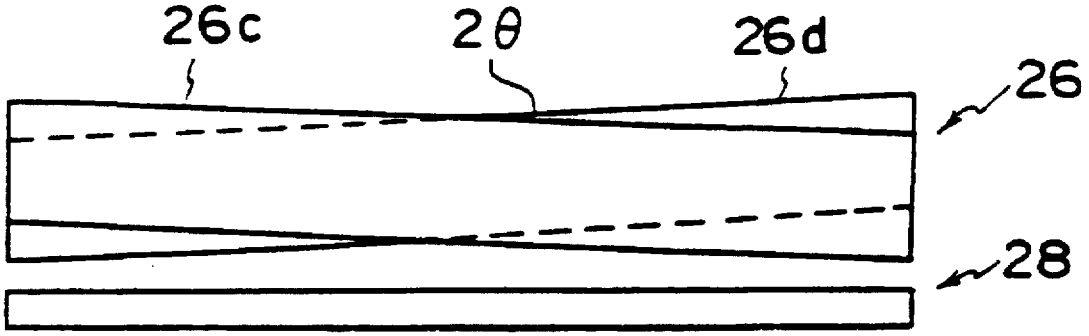
FIG. 8 (*a*) and (*b*) show the structures of a lens array and an optical shutter, respectively, in accordance with the second embodiment of the invention.
Figure 8B:
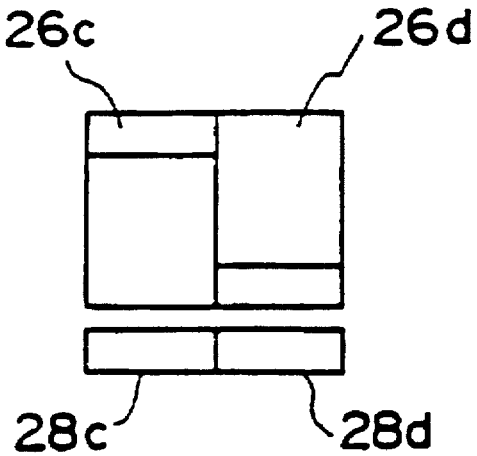

In the aforementioned first preferred embodiment, an embodiment in which the central optical axes of the first and the second lens arrays 26*a* and 26*b* were tilted along the lengthwise directions of the respective lens arrays was shown. By contrast, in the second preferred embodiment, as shown in the front view and side views in FIG. 8 (*a*) and (*b*), respectively, although a pair of lens arrays 26*c* and 26*d* is also used for the rod-lens array 26, lens arrays 26*c* and 26*d* are both of a regular type without any tilting of the central optical axes, and are configured to cross at a slight angle such that their lengthwise sides form a certain angle (e.g., 2 θ=0.178°) By constructing lens array 26 in this manner, the respective rod lenses of the first and the second lens arrays 26*c* and 26*d* form a certain angle θ on both sides of the aforementioned Y-axis. In other words, they form the angle 2 θ with respect to each other.

Installed in the housing 12 together with the first and the second lens arrays 26*c* and 26*d* is the optical shutter 28 consisting of corresponding first and second optical shutters 28*c* and 28*d*.

In the second preferred embodiment, aside from the arrangement the rod-lens array 26 and the shutter 28 as explained above, the arrangement is identical to that of the first preferred embodiment. By adopting this arrangement for the rod lens lens arrays 26 and the shutters 28, as in the first preferred embodiment, pixel latent images formed by combining light signals from LED's 14 using a first lens array 26*c* and a second lens array 26*d* are possible. Thus, using LED array 18 with LED's 14 of a certain pitch, the formation of images of double resolution is possible.

Needless to say, in the aforementioned first and second preferred embodiments, although the lenses of the first and the second lens arrays are arranged such that they tilt in opposite directions from each other, configurations involving the tilting of the lens of one lens array without the tilting of the lens of the other lens array are also possible.

Embodiment 3

Figure 9:
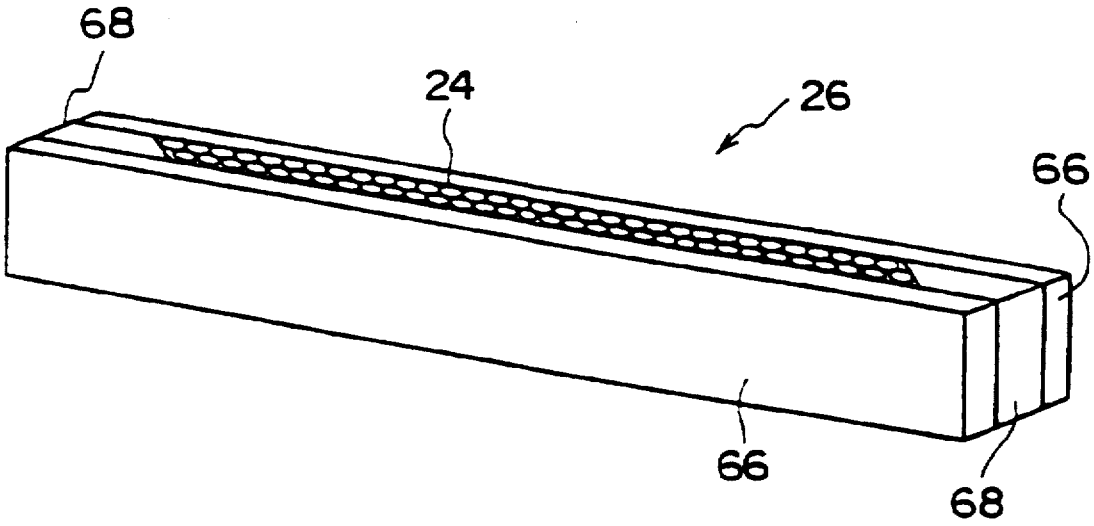
FIG. 9 shows a perspective view of a rod-lens array in accordance with the third embodiment of the invention.

Next, the third preferred embodiment will be explained. FIG. 9 shows a perspective view of a rod-lens array 26 according to the third preferred embodiment.

As shown in FIG. 9, the rod-lens array 26 comprises a pair of board-shaped structural supports 66 made of glass-epoxy type material elongated in a lengthwise direction of rod-lens array 26, a plurality of cylindrical rod lenses 24 placed between the support 66, and spacers 68 fixed at both ends of the rows of rod lenses in between the support 66. The plurality of rod lenses 24 are tilted slightly in the lengthwise direction of the support material 66 at a certain angle to one side and are fixed in position using epoxy resin. The rod lenses 24 shown in the example in FIG. 9 are arranged in a zigzag fashion.

Figure 10:
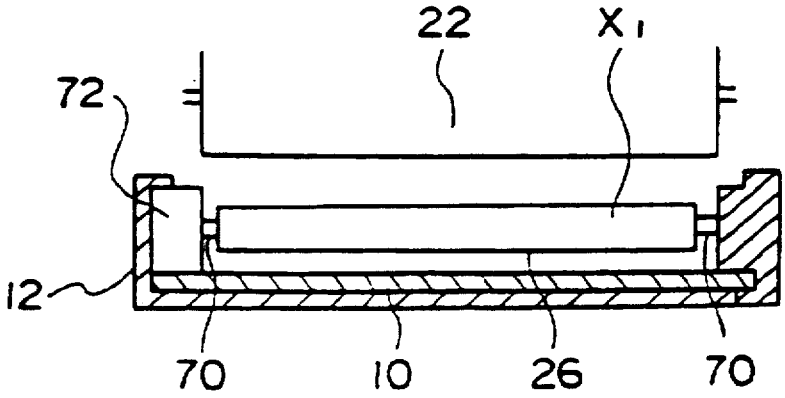
FIG. 10 shows an LED print head which utilizes the rod-lens array of FIG. 9.

In the third preferred embodiment, as shown in FIG. 10, a circuit substrate 10 with an electric circuit formed on its surface is fixed to the housing 12 which is made of resin. Although not shown in the drawing, as in the first and the second embodiment, an LED array with LED's arranged at a certain pitch for light emission as well as driver IC's to drive the LED's is mounted on the substrate 10. There is a support axis 70 on each end of the rod-lens array 26, of which one support axis 70 is mounted on the housing 12 so that it is free to rotate. The other support axis 70 is connected to a revolving axis of a revolving mechanism 72, and rod-lens array 26 rotates around the rotational axis $X_1$ which passes through the support axis 70 due to the rotational drive of the revolving mechanism 72.

Although a step motor with a rotation angle of 180° capable of intermittent rotation can be used for rotating mechanism 72, a regular continuous rotation motor can also be used. An LED print head of this construction condenses the light generated from the LED array via the rod-lens array 26, and stays at a fixed position relative to the light-sensitive drum 22 which revolves around an axis parallel to revolving axis $X_1$.

Figure 11:
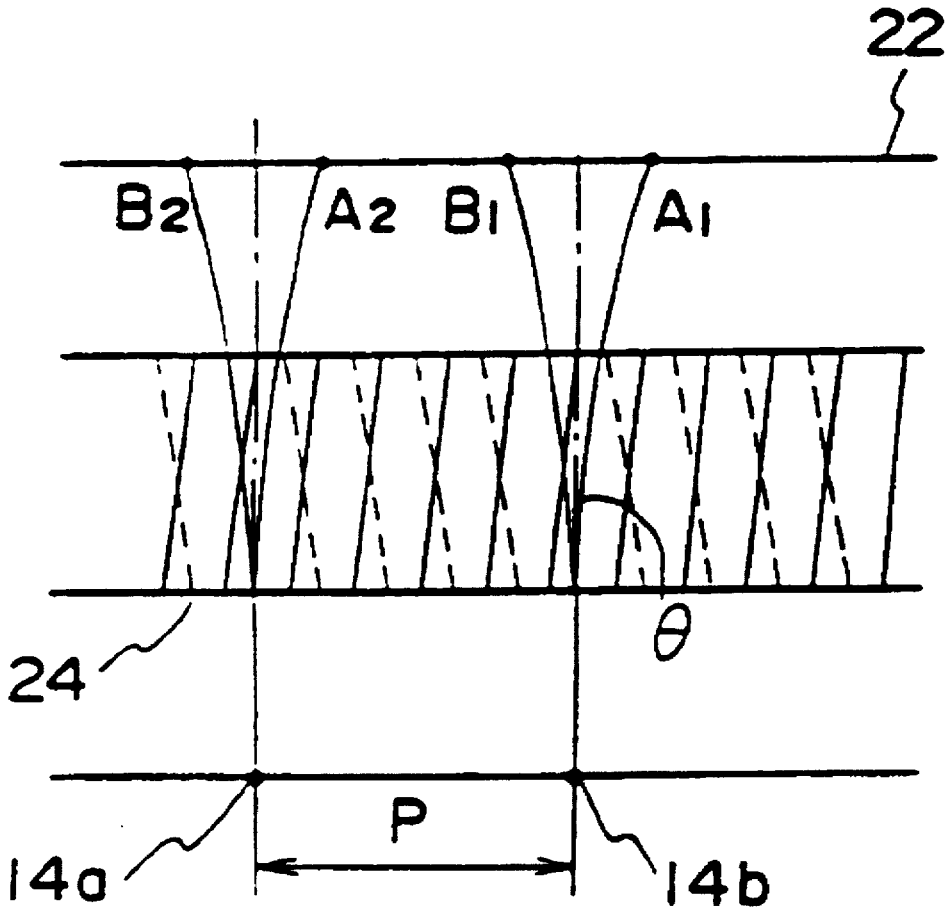
FIG. 11 shows the operation of an LED print head which utilizes the rod-lens array of FIG. 9.

The rod-lens array 26 of the third preferred embodiment, as shown in FIG. 11, consists of rod lenses 24 with optical axes that are slightly tilted in the lengthwise direction at a slight angle of θ. Therefore, the direction of the tilt reverses every 1860° rotation. In other words, in forming a graphical image along a single line, at an arbitrary point in time, when the rod lens 24 is in such a position as shown by the solid line in FIG. 11, if light is emitted from LED 14a which is set at a certain pitch P, the direction of the light will be changed as it follows the central optical axis of rod lens 24, and will form an image on the light-sensitive drum 22 at position $A_1$ displaced a certain distance to one side. At this time, if light is also emitted from adjacent LED 14*b*, it will also form an image on light-sensitive drum 22 at position $A_2$ also displaced a certain distance to one side.

Next, when the rod lens 24 rotates 180°, coming to the position shown by the dotted line, if light is emitted from LED 14*a*, the direction of the light will be changed as it follows the central optical axis of rod lens 24, and will form an image on the light-sensitive drum 22 at position $B_1$ displaced a certain distance to the other side. At this time, if light is also emitted from adjacent LED 14*b*, it will also form an image on light-sensitive drum 22 at position $B_2$ also displaced a certain distance to the other side.

As explained above, the third preferred embodiment uses a single rotating rod-lens array 26 instead of a pair of rod-lens arrays and an optical shutter to achieve the same results as the first preferred embodiment. By this means, double the resolution of the pitch of the LED's 14 can be obtained.

Embodiment 4

Figure 12:
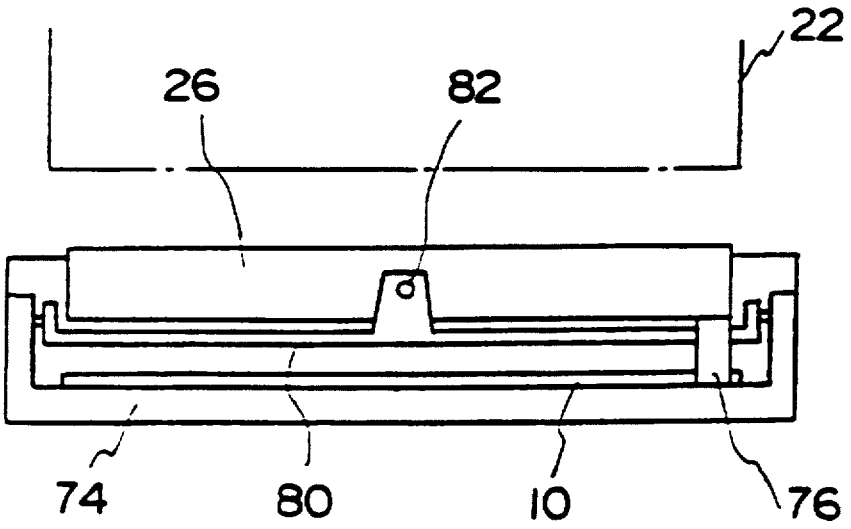
FIG. 12 is a simplified cross-sectional view of an LED print head in accordance with the fourth embodiment of the invention.

Next, the Preferred Embodiment 4 according to the invention will be explained. FIG. 12 shows a lengthwise cross-sectional view of the LED print head of the fourth preferred embodiment.

As shown in FIG. 12, the LED print head according to the fourth embodiment comprises: a substrate 10 made of glass-epoxy type material with the necessary elements for the electric circuit formed on the surface; an LED array (not shown) with a connection on the substrate 10 to the electric circuit, the LED's being arranged at a certain pitch; a rod-lens array 26 which is set apart from the LED array and which consists of a row of rod lenses which can be rotated by a slight angle; a casing 74 to keep the substrate 10 and the rod-lens array 26 at a certain position relative to each other; and a shifting mechanism 76 installed between the casing 74 and the rod-lens array 26 to rotate the rod-lens array 26 in accordance with electric signals from an electric circuit.

With respect to the rod-lens array 26, on the opposite side of the substrate 10 is a light-sensitive drum 22 which rotates at a certain speed along an, axis parallel to the arranging direction (the lengthwise direction) of the LED array, i.e., the main scanning direction.

Figure 13:
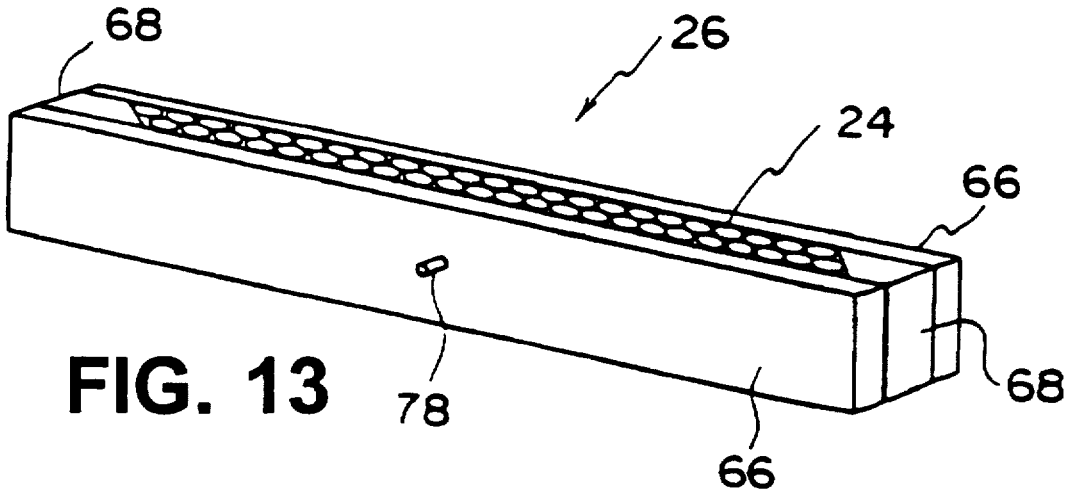
FIG. 13 is a perspective view of the lens array of the LED print head of FIG. 12.

As shown in FIG. 13, the rod-lens array 26 comprises a pair of board-shaped structural supports 66 made of glass-epoxy type material, a plurality of cylindrical rod lenses 24 placed between the support material 66 (in the embodiment of FIG. 13, the rod lenses are arranged in a zigzag configuration), and spacers 68 fixed at both ends of the row of rod lens 24, in between the support 66. Protruding at the center of the outer wall of the support 66, stretching in the secondary scanning direction, are a pair of secondary scanning direction support axes 78 (shown only partially in the drawing).

The rod-lens array 26 is held by holder 80 such that it is free to rotate. That is, referring back to FIG. 12, axis 78 which lies in the secondary scanning direction of rod-lens array 26 is fitted into the support holes 82 formed opposite each other in the secondary scanning direction at the center of the pair of lengthwise walls of the holder 80, which is of a simplified board shape made of resin. The rod-lens array 26 can therefore rotate with the secondary axis 78 as center.

The shifting mechanism 76 is made from a piezo actuator formed by layering piezo-ceramics. It expands and contracts in accordance with an electric signal from the electric circuit on substrate 10, to which it is electrically connected. The expansion and contraction causes the rod-lens array 26 to rotate with the secondary scanning direction axis 78 as its center.

Figure 14:
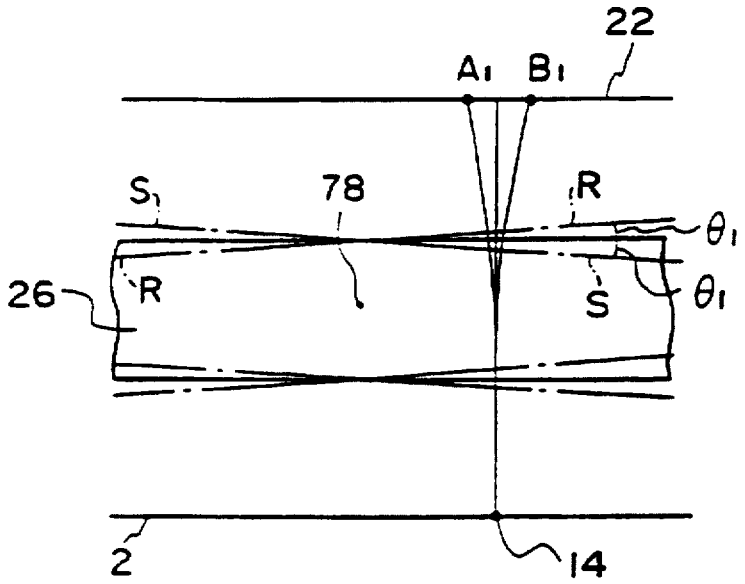
FIG. 14 shows operation of the LED print head of FIG. 12.

Next, the operation of the LED print head of the fourth embodiment will be explained. The operation of the LED print head of the fourth embodiment is shown in FIG. 14. In the drawing, the home position for the rod-lens array 26 is the position parallel to the LED array, and this position is indicated by the solid line. In the position shown by line R, in which the rod-lens array 26 tilts to one side at a slight angle $\theta_1$, with the secondary scanning direction axis as the center, if a light signal is emitted from an arbitrary LED 14, the direction of the light signal will be changed as it follows the central optical axis of rod lens 24 of rod-lens array 26 and forms an image on the light-sensitive drum 22 at position $A_1$ displaced a certain distance to one side.

If the lens array 26 is rotated by tilting to-the opposite side of the aforementioned side at a slight angle $\theta_1$, with the secondary scanning direction axis as the center, i.e., the position indicated by line S, a light signal emitted from the LED will likewise form an image at position B., displaced a certain distance to the other side of the main scanning direction.

From the above, in the fourth preferred embodiment, by vibrating a single rod-lens array 26 with the secondary scanning direction axis 78 as the center instead of using two rod-lens arrays and optical shutters, the same results as in the second preferred embodiment can be obtained. In this manner, double the resolution of the LED pitch can be obtained.

Embodiment 5

Figure 15:
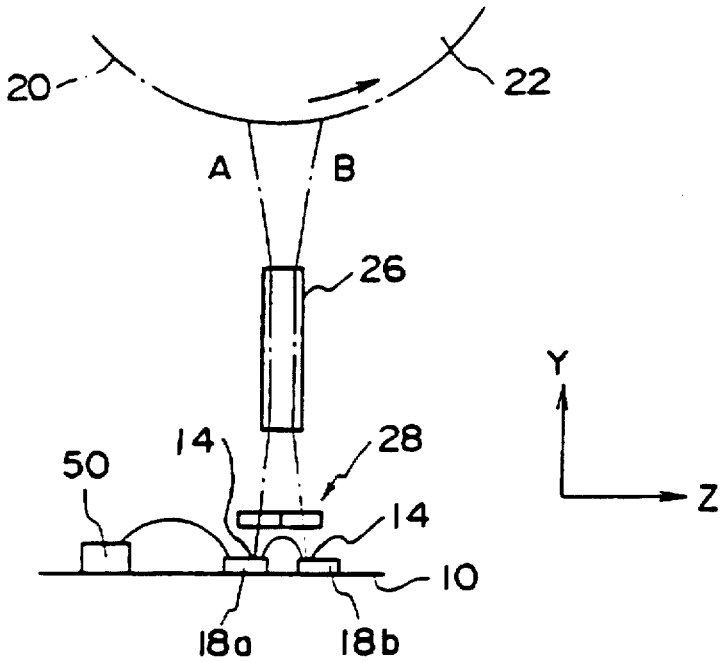
FIG. 15 shows the structure and operation of an LED print head in accordance with the fifth embodiment of the invention.
Figure 16:
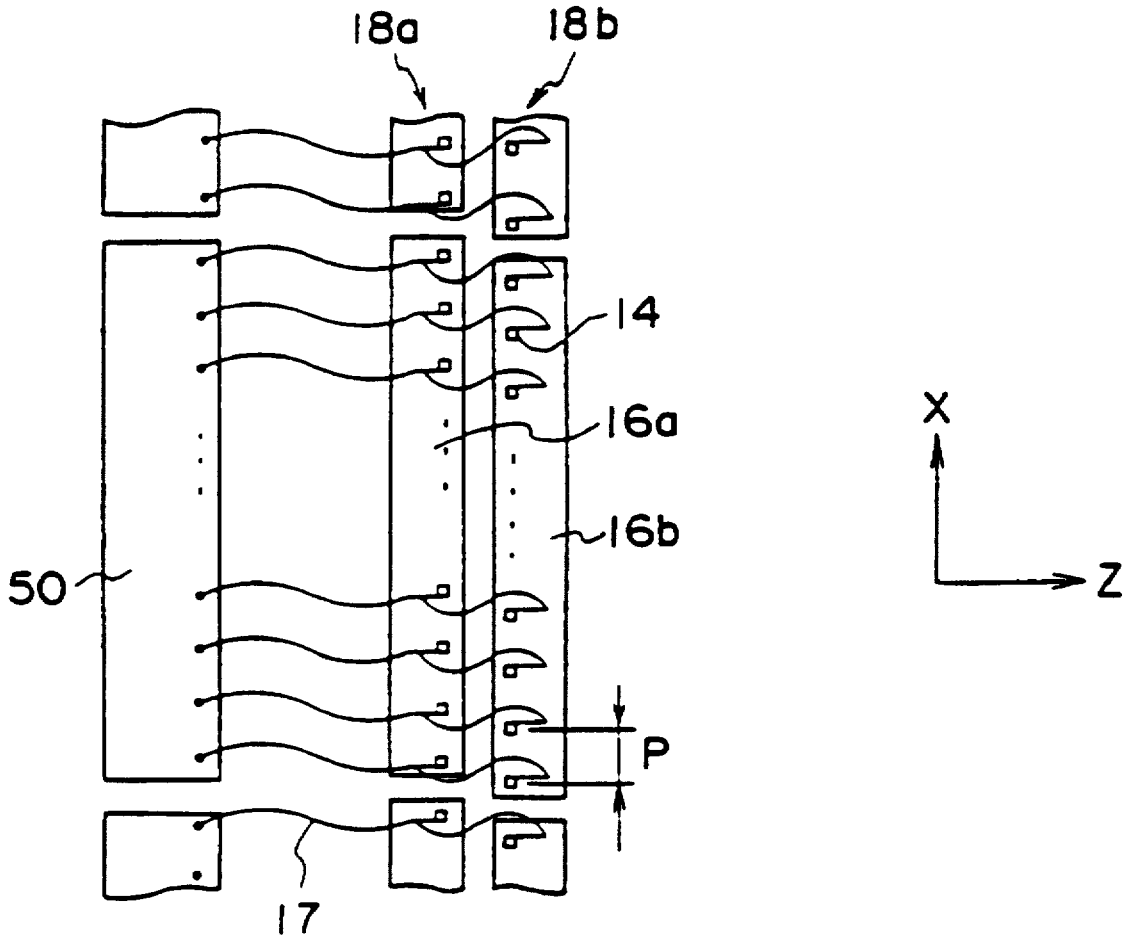
FIG. 16 is a top view showing the configuration of the LED array chips and driver IC's of the LED print head of FIG. 15.

Next, the fifth preferred embodiment of the invention will be explained. As shown in FIG. 15 and FIG. 16, the LED print head of the fifth preferred embodiment comprises: a first LED array **18*a* and a second LED array 18*b* consisting of LED's arranged on substrate 10 in the direction of the X-axis at a certain pitch, with the LED's of the second array displaced a half pitch with respect to the LED's of the first array; a driver IC 50 set parallel to the first and the second LED arrays 18*a* and 18*b* and electrically connected to them via bonding wires 17; a light-sensitive drum 22 which can rotate around an axis parallel to the aforementioned first and second LED arrays 18*a* and 18*b*, a rod lens array 26 which is positioned between the LED arrays 18*a*, 18*b* and the light-sensitive drum 22, and which condenses light signals indicated by the semi-dotted lines in the drawing generated by the first or the second LED array 18*a* or 18*b* onto the light-sensitive surface 20 of the light-sensitive drum 22; and an optical shutter 28 set under the rod-lens array 26**.

The rod-lens array 26 used in the fifth preferred embodiment, as in the second preferred embodiment, consists of a single rod lens array of the conventional type without any tilt, and the same types of optical shutters as in the aforementioned embodiment can be utilized.

As stated above, although the LED array of the fifth preferred embodiment consists of a first and a second LED array **18*a* and 18*b*, the light signals emitted from all the LED's 14 are condensed onto the light-sensitive surface 20 via a common optical shutter 28 and rod-lens array 26. Here, the first and the second LED arrays 18*a* and 18*b* are positioned such that they are slightly displaced in the Z-axis direction with respect to the central optical axis of each rod lens of the rod-lens array 26**.

In this case, with rod-lens arrays of this type available on the market, an aberration of ±0.4 mm hardly causes any change or loss in light intensity, and manufacturing 2 rows of LED arrays on the required scale will hardly cause any problems in production. However, these problems can be more completely solved by using ready-made rod-lens arrays with lenses arranged in a zigzag configuration.

One such rod-lens array is the rod-lens array with the product name SLA-20 sold by Nihon Itagarasu Kabushiki Kaisha. The SLA-20 maintains a constant light intensity for a range within ±0.4 mm of the central optical axes of the lenses of the rod-lens array, and is therefore sufficient for the purposes of this embodiment.

In the process of image formation, with the rotation of the light-sensitive drum 22, the LED's 14 of the first LED array **18*a* are made to emit light signals by the electrical signal from the driver IC 50. By simultaneously opening the corresponding optical shutters of optical shutter 28, the light signals are condensed onto the light-sensitive surface 20 of light sensitive drum 22 at position A via the lens array 26, forming a pixel latent image. Subsequently, at the point when the formed latent image has rotated from position A to position B, the LED's 14 of the second LED array 18***b* are made to emit light signals at the same time that the optical shutters are opened, with the result that a pixel latent image is formed on the light-sensitive surface 20 of the light-sensitive drum 22 at rotation position B, which lies on the same line as the pixel latent image formed at position A.

At this point, as shown in FIG. 16, since the respective LED's 14 of the first LED array 18*a* and the second LED array 18*b* are set at positions displaced a half-pitch with respect to each other, the pixel latent images from the second LED array 18*b* are formed at a certain pitch at intermediary positions displaced a half-pitch with respect to the pixel latent images formed by the first LED array 18*a*, with both pixel latent images falling on the same line.

Embodiment 6

Figure 17:
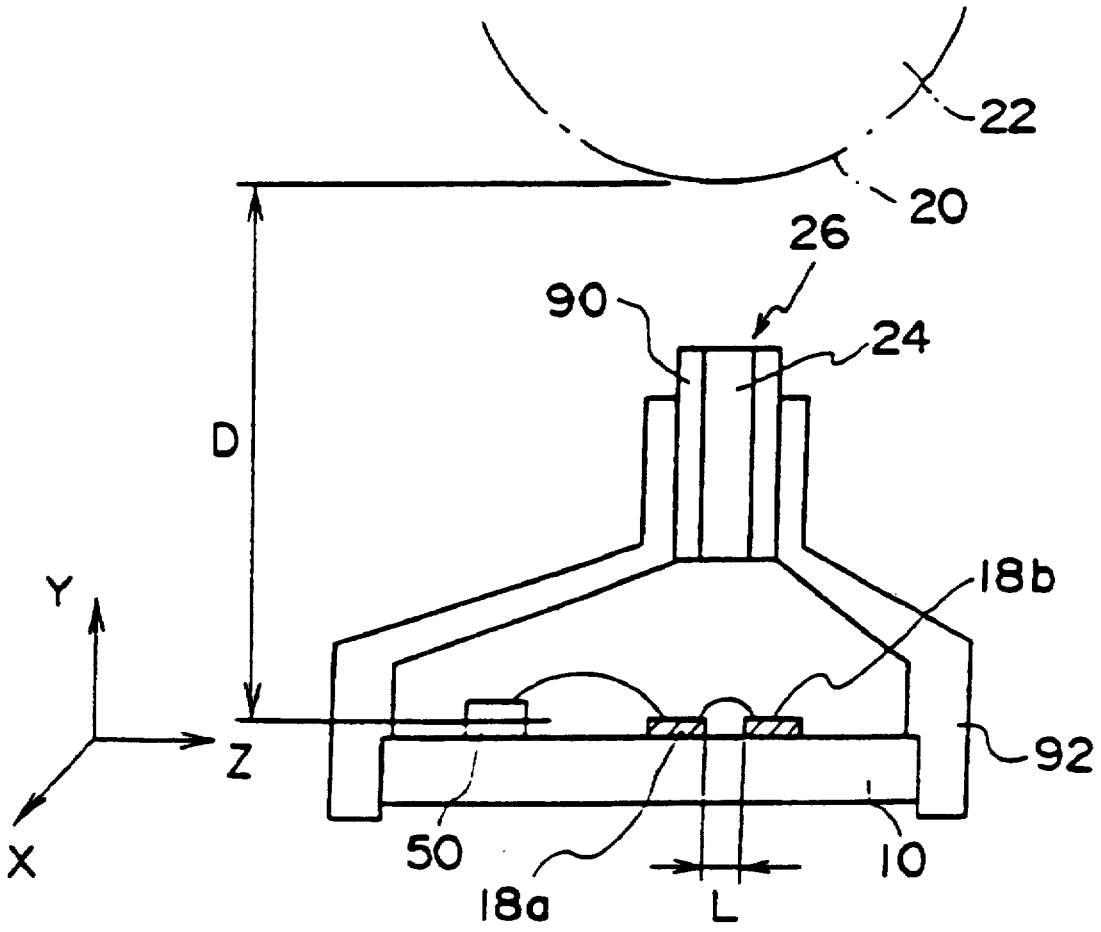
FIG. 17 is a cross-sectional view of an LED print head in accordance with the sixth embodiment of the invention.

Next, the sixth preferred embodiment of the invention will be explained. FIG. 17 is a cross-sectional view showing the main parts of the LED print head of Preferred Embodiment 6.

As in Preferred Embodiment 5 shown in FIG. 16, the first and the second LED arrays 18*a* and 18*b* are formed by displacing LED array chips 16*a* and 16*b* by a half pitch (P/2) with respect to each other, each thus being formed in a continuous configuration. The LED array chips 16*a*, 16*b* have a plurality of LED's 14 arranged at a fixed pitch P in the main scanning direction (x-axis direction).

Figure 22:
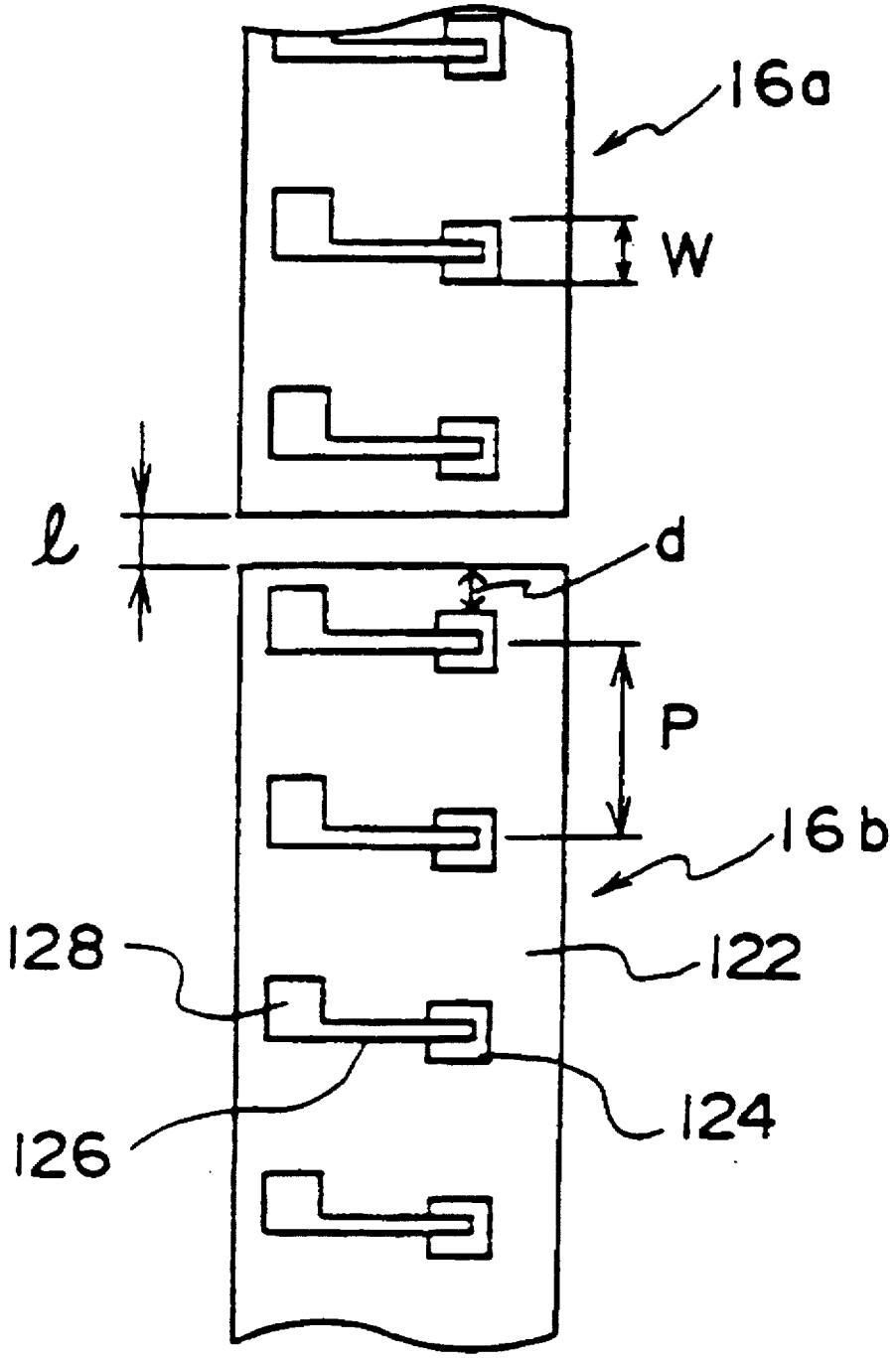
FIG. 22 is a top view of the arrangement of conventional LED array chips.

Although each LED array chips 16*a* and 16*b* is basically of the same structure as that of FIG. 22, for instance, the substrate 122 of the embodiment is of GaAs material, with a plurality of LED's formed in a row on the substrate 122. Each LED is formed by forming on the GaAs substrate 122 a GAAsP layer, on which a P-type diffusion layer 124, the light-emitting area, is formed by impurity diffusion using Zn. The electrode 126 is made of conducting material, and is electrically connected to the surface of the diffusion layer 124 at one end and has a pad 128 at the other end which can be connected via wire bonding to the circuit wiring of substrate 10. LED array chips 16*a* and 16*b* are positioned on the substrate with distance 1 between them such that the LED's are lined up in a row.

Figure 18:
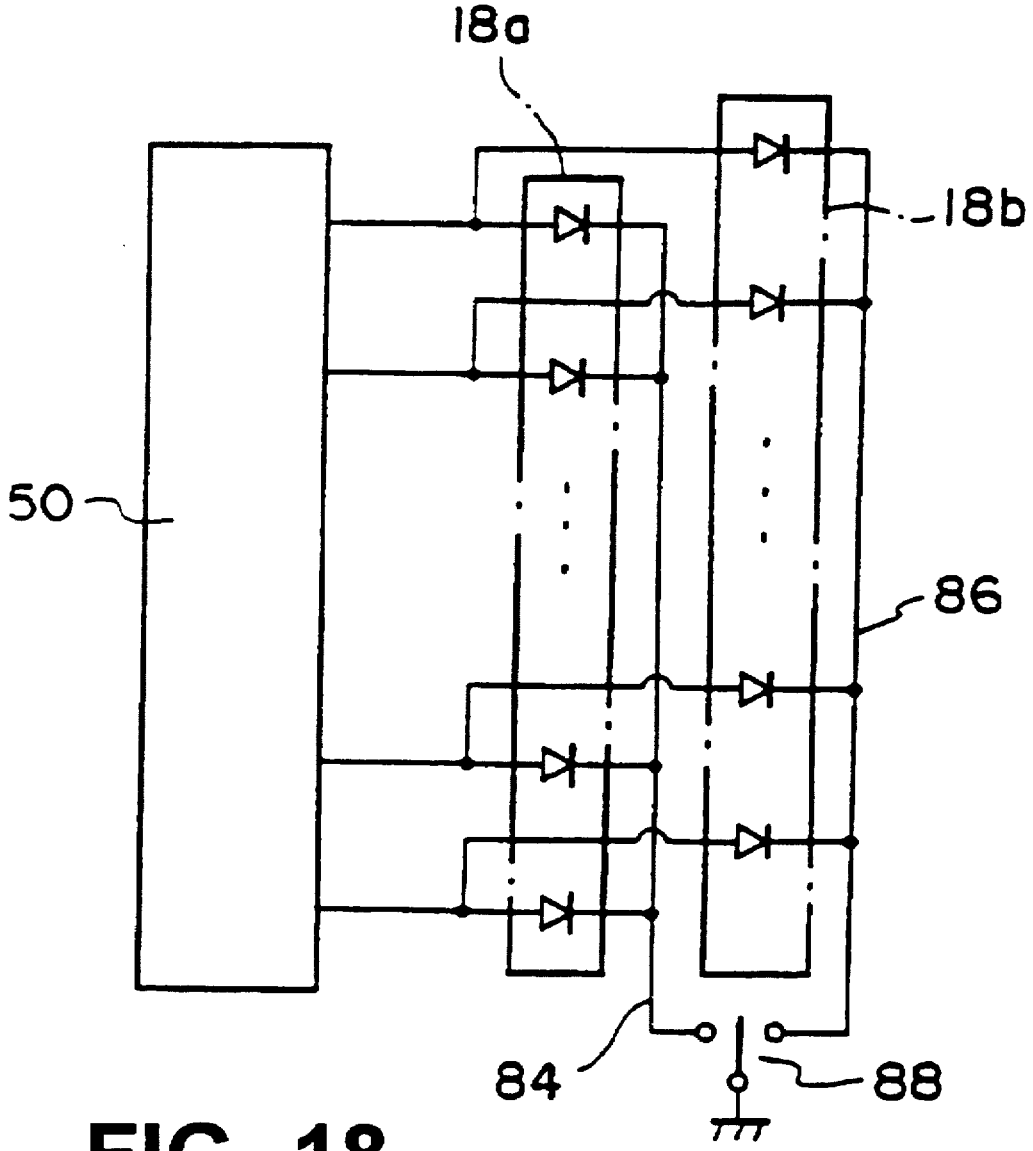
FIG. 18 is a top view of the electrical connections between the LED array and driver IC of the LED print head of FIG. 17.

The electrical connection between the LED's and the driver IC 50 of the LED arrays 18*a* and 18*b* is shown in FIG. 18. Here, the anode of each LED of the first LED array 18*a* is electrically connected to the corresponding electrode pad of the driver IC, and the cathodes are connected to a common line, the first cathode line 84. The anode of each LED of the second LED array 18*b* is connected to the anode of the corresponding LED of the first LED array 18*a*, and the cathodes are connected to a common line, the second cathode line 86. The ends of first and second cathode lines 84 and 86 are connected to a switch 88 to allow for selective switching.

Referring back to FIG. 17, above the first and the second LED arrays 18*a* and 18*b* is a cylindrical light-sensitive drum 22 with a light-sensitive surface 20 positioned to rotate along an axis in the X direction. The light signals generated by the LED's are irradiated onto the light-sensitive surface 20.

Between the light-sensitive surface 20 of the light-sensitive drum 22 and the LED arrays 18*a* and 18*b* is a rod-lens array 26 consisting of a plurality of cylindrical rod lenses 24 with appropriate focal lengths such that the light from the LED's will form images on the light-sensitive surface 20. The rod-lens array 26 consists of rod lenses 24 which are positioned parallel to each other along the X-axis between the support 90, and is inserted together with the substrate 10 into the casing 92, which is made of resin.

LED arrays 18*a* and 18*b* are separated by distance D along the Y-axis from the light-sensitive surface, with the rod-lens array 26 positioned in between.

Figure 19:
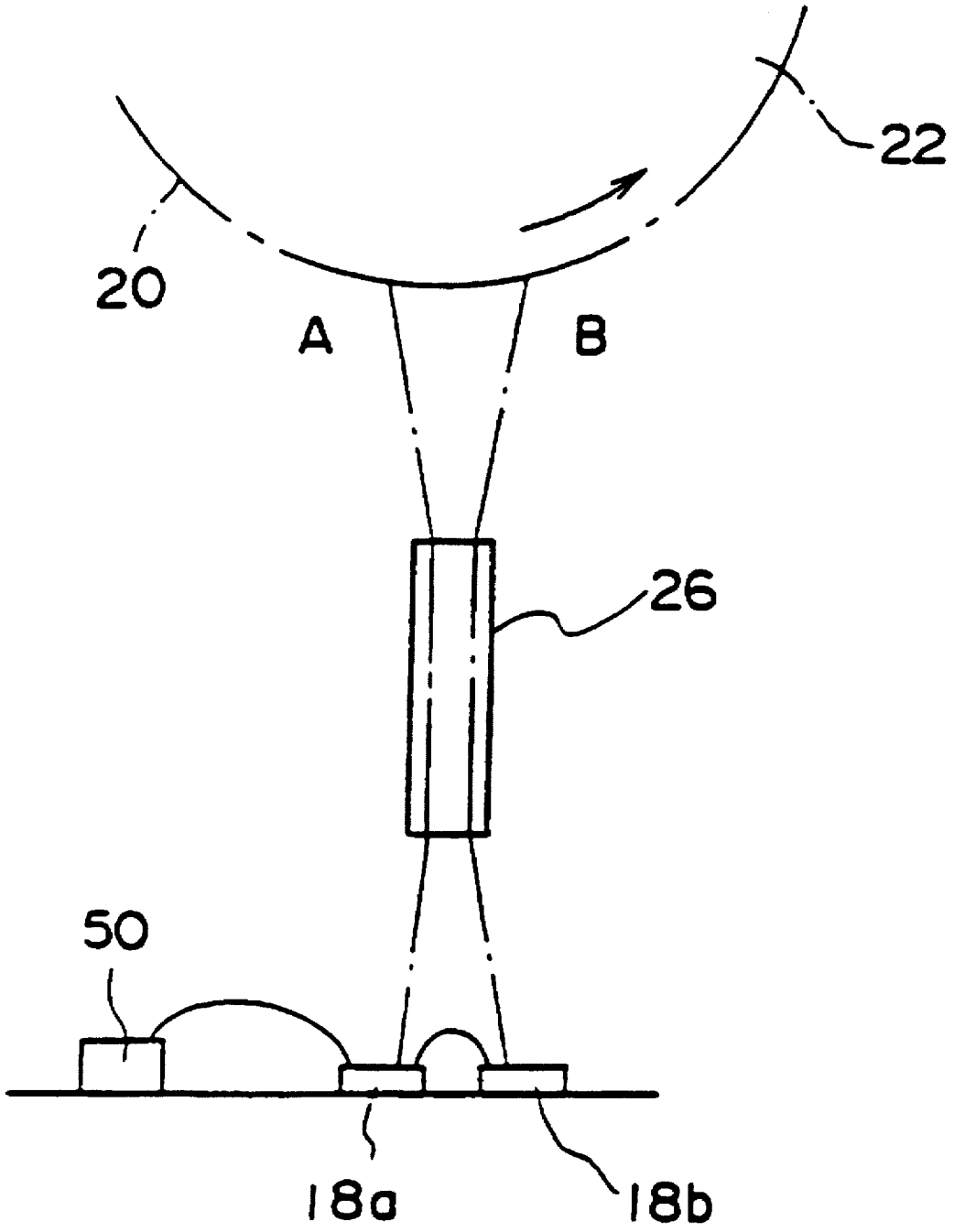
FIG. 19 shows the operation of the LED print head of FIG. 17.

Next, image formation in the main scanning direction (x-axis direction) using the LED print head of the embodiment as described above will be explained with reference to FIG. 19.

With the rotation of the light-sensitive drum 22, the driver IC 50 sends an electric signal and, synchronized with the signal, the switch 88 is switched, selectively closing the circuit for the LED's of the first LED array 18*a* and causing the emission of light signals. The light signals are condensed at position A on the light-sensitive surface 20 of the light-sensitive drum 22 via the rod-lens array 26, and pixel latent images are formed along the scanning line. At this point, the circuit of the second LED array 18*b* is broken.

Next, when the formed pixel latent images have rotated from position A to position B, synchronously with the rotation of the light-sensitive drum 22, the switch 88 is switched to the side of the second LED array 18*b*, breaking the circuit of the first LED array 18*a* and selectively closing the circuit for the second LED array 18*b*. This causes the LED's of the second LED array 18*b* to generate light signals, and a pixel latent image with a certain pitch is formed at position B on the light-sensitive surface 20.

At this point, since the first LED array 18*a* and the second LED array 18*b* are displaced a half pitch (P/2) in the X-axis direction with respect to each other, as mentioned above, pixel latent images from the second LED array 18*b* fall in between pixel latent images from the first LED array 18*a* at a certain pitch, with both pitches being the same. Thus, the pixel latent images are formed along the same line.

Here, as shown in FIG. 17, LED arrays 18*a* and 18*b* of the embodiment are formed from two rows of LED's. Therefore, for instance, if the zigzag configuration rod lens 24 is used for rod-lens array 26, depending on the distance settings, it may be necessary to shift the positions for LED array 18*a* and 18*b* slightly from the central optical axis in the Z-axis direction, and as a result the intensity of light passing through rod-lens array 26 may be insufficient.

Conventional rod-lens arrays on the market can tolerate a displacement of ±0.4 mm from the central optical axis with hardly any change in light intensity, and manufacturing both LED arrays to these distance specifications poses hardly any problems with respect to production precision. However, the aforementioned problem can be completely resolved be using rod-lens arrays with a plurality of rod lenses arranged in parallel configuration.

An example of rod-lens arrays that can be used in the invention is the SLA-20, a rod-lens array sold by Nihon Itagarasu Kabushi ki Kaisha. With the SLA-20, light intensity remains practically constant in the range of ±0.4 mm from the central optical axis, and the use of such rod lenses either individually or severally in parallel configuration in this invention is desirable.

By forming LED print heads as described above, even if each LED array, namely the first LED array 18*a* and the second LED array 18*b*, has a pixel density of conventional order—300 dpi, for instance, the aforementioned combination of pixel latent images can actually yield graphical images of double the resolution.

Figure 20:
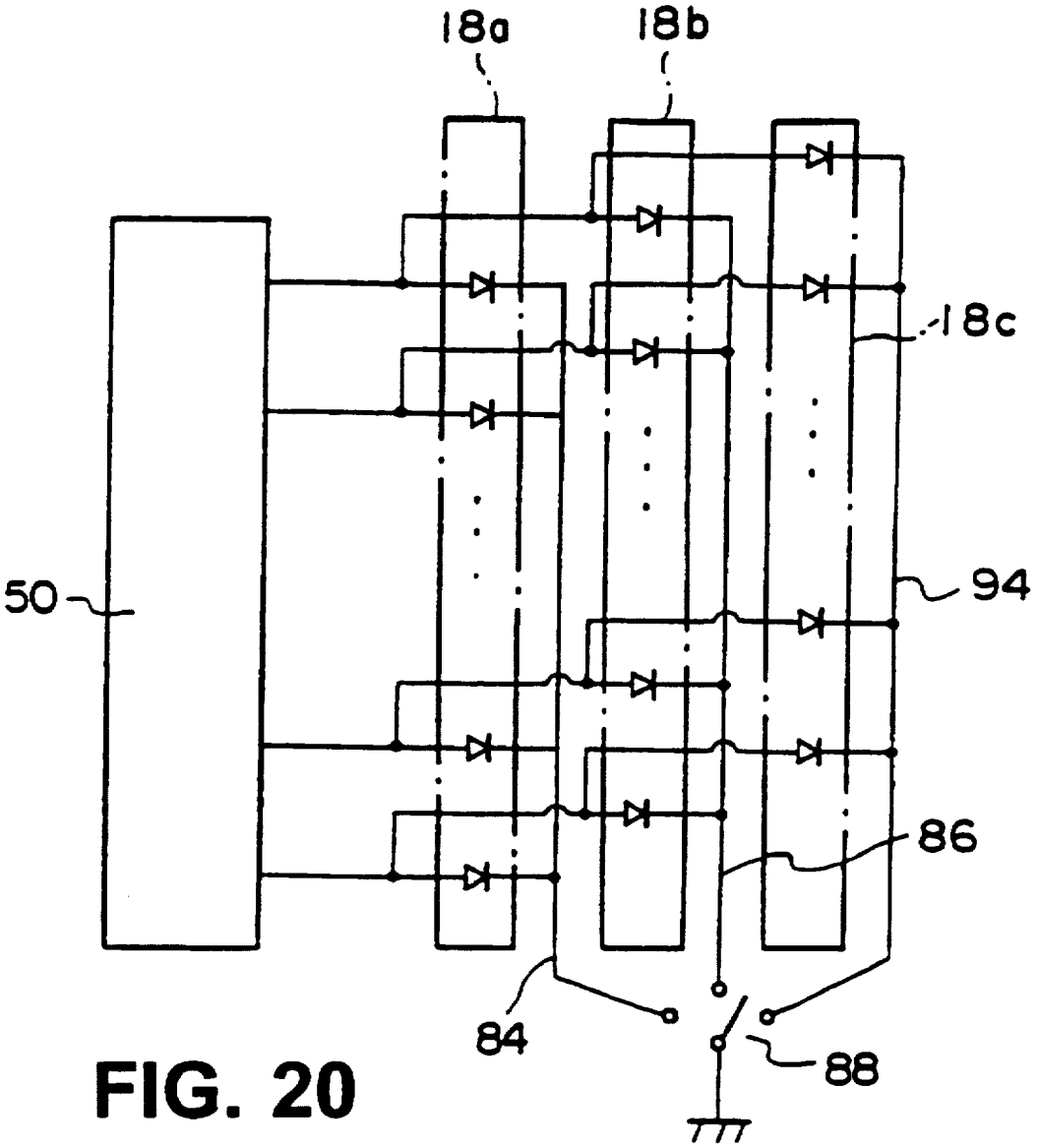
FIG. 20 is a top view of another instance of electrical connections between the LED array and driver IC of the LED print head of FIG. 17.
Figure 21:
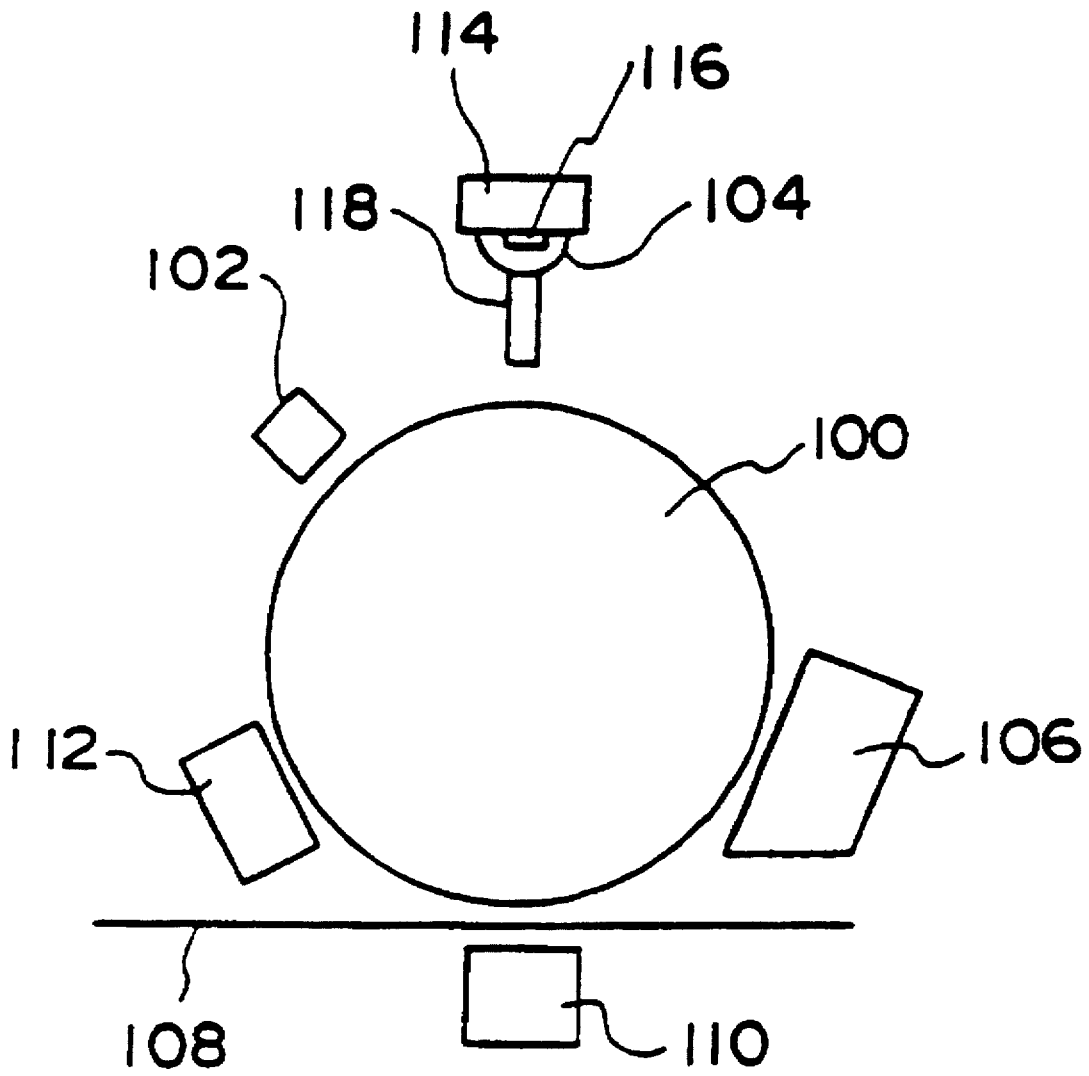
FIG. 21 shows the configuration of the main elements of a conventional LED printer.

In the aforementioned embodiment, an example using an LED array consisting of two arrays, a first and a second LED array 18*a* and 18*b*, was described. However, it is also possible to add a third LED array 18*c*, as shown in FIG. 20.

The anode of each LED of the third LED array 18*c* is electrically connected to the corresponding anode of the second LED array 18b, and the cathodes are connected to a common line, the third cathode line 94. The ends of the first, second and third cathode lines are connected to the switch 88. Aside from these changes, the print head is identical to that shown in FIG. 18.

Thus, the LED array is not restricted to two arrays, but can include a third array, as described above, or even include four or more arrays. In these cases, each LED array is shifted (P/number of LED arrays) pitch with respect to the others, in the main scanning direction, where P is a pitch of LED's. Therefore, the LED's on the LED array chips are displaced (P/number of LED arrays) pitch with respect to each other.

By forming the LED print head in this manner, using LED arrays of a single type with the same pixel densities, it is possible to obtain graphical images with resolutions multiplied by the number of LED arrays used.

POSSIBILITIES FOR INDUSTRIAL USE

As explained above, with the LED print head of the invention, in forming a pixel latent image on a single line, first, the light signals generated from LED's are irradiated via a rod-lens array and an opened optical shutter onto the light-sensitive surface of a light-sensitive drum to form pixel latent images at a fixed pitch, and secondly, another set of light signals generated from LED's are irradiated via a rod-lens array and an opened optical shutter onto the light-sensitive surf ace of a light-sensitive drum to form pixel latent images at a fixed pitch in between the pixel latent images already formed by the aforementioned light signals.

Therefore, using LED arrays with LED's spaced at a certain pitch, it is possible to form graphical images with double the pixel density or resolution.

Further, with the rotation of a light-sensitive drum, by sending an electrical signal from a driver IC and synchronously breaking the circuit of the second LED array and selectively closing the circuit for the LED's of the first LED array by means of a switch and causing the emission of light signals, light signals can be generated which by means of a rod-lens array are made to focus on a light-sensitive surface of a light-sensitive drum to form pixel latent images along the scanning line. Next, synchronously with the rotation of the light-sensitive drum, the switch is flipped to the second LED array side, opening the circuit of the first LED array and selectively closing the circuit of the second LED array. From the light signals generated from the LED's of the second array, pixel latent images are formed at a certain pitch in the space between the afore-mentioned pixel latent images.

Here, by positioning the first LED array and the second LED array such that the LED's of the second array are shifted by a half-pitch (P/2) in the main scanning direction with respect to those of the first array, pixel latent images from both LED arrays can be combined in a single line to form a high-resolution graphical latent image.

Further, by increasing the rows in the LED array, graphical images with resolutions increased by a factor of the number of rows can be obtained.

Therefore, the resolution can be greatly increased without changing the formation density of the LED's in LED arrays.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. An LED print head, comprising:

an LED array with LEDs extending in a main scanning direction configured to selectively generate light signals;

light-sensitive material that can be rotated around an axis parallel to the main scanning direction;

a lens array comprising lenses arranged such that light signals generated by the LEDs are condensed onto the light-sensitive material; and optical shutters positioned between the LED array and the lenses and configured to channel light signals from the LED array through designated lenses, wherein:

the lens array comprises a first and a second lens array;

the first lens array comprising lenses with central optical axes titled at a first slight angle about a first array axis parallel to the main scanning direction; and the second lens array comprising lenses with central optical axes tilted at a second slight angle about a second array axis parallel to the main scanning direction in a direction opposite to that of the tilt of the first lens array.

2. An LED print head, comprising:

an LED array with LEDs extending in a main scanning direction configured to selectively generate light signals;

light-sensitive material that can be rotated around an axis parallel to the main scanning direction;

a lens array comprising lenses arranged such that light signals generated by the LEDs are condensed onto the light-sensitive material; and optical shutters positioned between the LED array and the lenses and configured to channel light signals from the LED array through designated lenses, wherein:

the lens array comprises a first and a second lens array;

the first lens array comprising lenses with central optical axes tilted at a slight angle about a first array axis parallel to the main scanning direction; and the second lens array comprising lenses with central optical axes substantially perpendicular to the LED array.

3. The LED print head of claim 1, or claim 2, wherein the first and second lens arrays are positioned to form a V- or inverted V-shape, when viewed from the main scanning direction.

4. An LED print head, comprising:

an LED array with LEDs extending in a main scanning direction configured to selectively generate light signals;

light-sensitive material that can be rotated around an axis parallel to the main scanning direction;

a lens array comprising lenses arranged such that light signals generated by the LEDs are condensed onto the light-sensitive material; and optical shutters positioned between the LED array and the lenses and configured to channel light signals from the LED array through designated lenses, wherein:

the lens array comprises a first and a second lens array,, the first and second lens arrays each having sides extending in a plane parallel to the main scanning direction; and the first and second lens arrays are tilted about an axis orthogonal to the main scanning direction such that the sides of the first lens array form a predetermined angle relative to the sides of the second lens array.

5. An LED print head, comprising:

an LED array with LEDs extending in a main scanning direction configured to selectively generate light signals;

light-sensitive material that can be rotated around an axis parallel to the main scanning direction;

a lens array comprising lenses arranged such that light signals generated by the LEDs are condensed onto the light-sensitive material; and optical shutters positioned between the LED array and the lenses and configured to channel light signals from the LED array through designated lenses, wherein:

the LEDs of the LED array are arranged in a plurality of rows, the rows extending in the main scanning direction; the LEDs within each row are spaced by an LED pitch; and the rows are shifted with respect to each other in the main scanning direction by the LED pitch divided by the number of rows.

6. The LED print head of claim 5, wherein the optical shutter comprises a ferroelectric liquid crystal shutter.

7. The LED print head of claim 5, wherein the optical shutter comprises electro-optical ceramics.

8. An LED print head, comprising:

an LED array comprising a first and a second row of LEDs, the LEDs of each row being connected to a common wire;

a driver IC that is electrically connected to the rows of LEDs;

a lens array comprising lenses arranged such that light signals generated by the LEDs in accordance with electric signals from the driver IC are condensed onto a light-sensitive surface; and a switch connected to the common wire of each of the rows, wherein the LEDs within each row are spaced by an LED pitch and the rows are shifted with respect to each other in the main scanning direction by the LED pitch divided by the number of rows.

* * * * *